United States Patent [19]

Neuroth

[11] Patent Number: 5,051,103

[45] Date of Patent: Sep. 24, 1991

[54] ELECTRICAL COUPLING ASSEMBLY FOR HOT, HIGH PRESSURE SERVICE

[75] Inventor: David H. Neuroth, Hamden, Conn.

[73] Assignee: Hubbell Incorporated, Orange, Conn.

[21] Appl. No.: 594,002

[22] Filed: Oct. 9, 1990

[51] Int. Cl.[5] ..... H01R 4/60

[52] U.S. Cl. ..... 439/192; 439/204; 439/275

[58] Field of Search ..... 439/190–192, 439/194, 195, 199, 201, 204, 271, 275, 276, 283, 623, 624, 162, 163, 164

[56] References Cited

U.S. PATENT DOCUMENTS

| | | | |
|---|---|---|---|
| 2,177,508 | 10/1939 | Abbott | 201/64 |
| 2,760,175 | 8/1956 | Dunn | 339/94 |
| 3,197,730 | 7/1965 | Hargett | 339/102 |
| 3,681,739 | 8/1972 | Kornick | 339/94 C |
| 3,989,330 | 11/1976 | Cullen et al. | 339/16 R |
| 4,050,765 | 9/1977 | Duesterhoeft et al. | 439/204 |
| 4,060,299 | 11/1977 | Williams | 339/48 |
| 4,154,302 | 5/1979 | Cugini | 166/315 |
| 4,494,811 | 1/1985 | Palermo | 439/190 X |
| 4,500,156 | 2/1985 | Nguyen | 439/190 |
| 4,553,807 | 11/1985 | Cane | 439/190 |
| 4,588,247 | 5/1986 | Grappe et al. | 339/94 M |
| 4,589,717 | 5/1986 | Pottier et al. | 339/94 M |
| 4,673,231 | 6/1987 | McAnulty, Sr. | 439/271 X |
| 4,693,540 | 9/1987 | Cane | 439/198 |
| 4,727,223 | 2/1988 | Lee et al. | 174/151 |
| 4,797,117 | 1/1989 | Ayers | 439/271 X |
| 4,854,886 | 8/1989 | Neuroth | 439/192 |
| 4,907,980 | 3/1990 | Wagaman et al. | 439/199 X |
| 4,927,386 | 5/1990 | Neuroth | 439/589 |
| 4,940,416 | 7/1990 | Wagaman et al. | 439/199 X |
| 4,959,022 | 9/1990 | Neuroth | 439/589 |

FOREIGN PATENT DOCUMENTS 860048 2/1961 United Kingdom .

*Primary Examiner*—Larry I. Schwartz
*Assistant Examiner*—Julie R. Daulton
*Attorney, Agent, or Firm*—Jerry M. Presson; Alfred N. Goodman; David L. Tarnoff

[57] ABSTRACT

An electrical coupling assembly for conducting electricity between two areas of different pressures including a hollow housing extending between the areas of different pressures, an upper electrical cable connector slidably coupled within the upper end of the housing, an upper penetrator assembly located in the housing for sealing the upper end of the housing, three electrical conductors located in the housing for conducting electricity between the upper and lower ends of the housing, a lower penetrator assembly located in the housing for sealing the lower end of the housing, and a lower electrical cable connector slidably coupled within the lower end of the housing. The longitudinal axes of the upper connector, upper penetrator assembly, and upper connecting ends of the conductors are offset from the longitudinal axes of the lower connector, lower penetrator assembly, and the lower connecting ends of the conductors. Each of the upper and lower penetrator assemblies has a seal initially compressed by spring washers. The spring washers are located below the seals to provide redundant sealing for preventing oil well fluids from leaking out of the oil well. The upper and lower connectors are slidably coupled within the housing and exposed to the external pressures for maintaining the pressure inside the housing at least equal to the pressure outside the housing.

20 Claims, 4 Drawing Sheets

ELECTRICAL COUPLING ASSEMBLY FOR HOT, HIGH PRESSURE SERVICE

FIELD OF THE INVENTION

The invention relates to an electrical coupling assembly for conducting electricity between areas of different pressures. More particularly, the invention relates to an electrical penetrator for use in a subsea wellhead tubing hanger or an oil well packer to conduct electricity between low and high pressure areas found in an oil well.

BACKGROUND OF THE INVENTION

In various applications of electrical power cable, it is necessary to carry electricity from a low pressure region to a high pressure region, or vice versa. For example, electrical submersible pumping systems used in oil wells often contain a seal device, usually referred to as a packer, to isolate one portion of the well from another. Electrical power in these instances must be taken through the packer to energize, for example, a pump motor below the packer. The device for conducting electricity through the packer is usually referred to as a penetrator.

In these environments, the main problem associated with the penetrator is to avoid disruption of the electrical connection due to leakage in the penetrator and exposure of the electrical conductors to oil, brine and other oil well fluids. In addition, these penetrators must be operable over a wide range of temperatures, typically from freezing to 300° F. or more and therefore must absorb stresses from thermal expansion. Likewise, the penetrators typically are exposed to pressure differentials up to 5,000 psi.

While many prior art penetrators are known, they have numerous disadvantages. First many of these prior art devices do not provide adequate sealing against contamination from external fluids, resulting in a degradation of the electrical insulation of the penetrator. In addition, many of these prior art devices are difficult to install in subsea hangers since the subsea hanger is relatively small at its bottom. Moreover, these prior art devices do not provide adequate sealing against oil well fluids leaking out into the environment.

Examples of these prior art devices are disclosed in the following U.S. Pat. Nos. 2,177,508 to Abbott; 2,760,175 to Dunn; 3,197,730 to Hargett; 3,681,739 to Kornick; 3,989,330 to Cullen et al; 4,500,156 to Nguyen; 4,553,807 to Cane; 4,060,299 to Williams; 4,154,302 to Cugini; 4,050,765 to Duesserhoept et al; 4,588,247 to Grappe et al; 4,589,717 to Pottier et al; 4,693,540 to Cane; 4,727,223 to Lee et al; and 4,854,886 to Neuroth the disclosures of which are hereby incorporated herein by reference.

SUMMARY OF THE INVENTION

Accordingly, a primary object of the present invention is to provide an electrical coupling assembly in the form of a penetrator for hot, high pressure service which is reliable, durable and provides a viable sealing of the interface between areas of different pressure, while resisting degradation of the electrical insulation therethrough.

Another object of the present invention is to provide an electrical penetrator that permits the longitudinal axis of the upper electrical cable connector to be offset from the longitudinal axis of the lower electrical cable connector.

Another object of the invention is to provide a pressure-equalizing assembly at opposite ends of the penetrator to assure that the interior of the penetrator has a pressure equal to or greater than the exterior pressure on the opposite ends of the penetrator to protect the interior from contamination by external fluids.

Another object of the invention is to provide an electrical penetrator with a pair of seals for providing extra protection against leakage of well fluids into the ocean.

Another object of the invention is to provide an electrical penetrator that is relatively simple and easy to install and to manufacture.

The foregoing objects are basically attained by providing an electrical coupling assembly for conducting electricity between areas of different pressures, the combination comprising: a hollow housing having first and second open ends, and an inner tubular surface, the first and second open ends being located respectively in areas of different pressures; an interconnecting member, located in the housing, for conducting electrical current between the first and second open ends of the housing, the interconnecting member has a first connecting end with a first longitudinal axis and a second connecting end with a second longitudinal axis offset from the first longitudinal axis; a first sealing member, located in the housing and engaging the inner surface of the housing, for sealing the housing and the interconnecting member adjacent the first open end of the housing; and a second sealing member, located in the housing and engaging the inner surface of the housing, for sealing the housing and the interconnecting member adjacent the second open end of the housing.

The foregoing objects are also basically attained by providing an electrical coupling assembly for conducting electricity between the areas of different pressures, the combination comprising: a hollow housing having first and second open ends and an inner tubular surface, the first open end being located in a first area having a first pressure and the second open end being located in a second area having a second pressure of higher pressure than the first area; an interconnecting member, located in the housing, for conducting electrical current between the first and second open ends of the housing; a first sealing member, located in the housing and engaging the inner surface of the housing, for sealing the housing and the interconnecting member adjacent the first open end of the housing; a first compression assembly, located in the housing between the first sealing member and the second open end of the housing, for exerting an axially directed compression force on the first sealing member; a second sealing member, located in the housing and engaging the inner surface of the housing, for sealing the housing and the interconnecting member adjacent the second open end of the housing; and a second compression assembly, located in the housing between second sealing member and the second open end of the housing, for exerting an axially directed compression force on the second sealing member.

Other objects, advantages and salient features of the invention will become apparent from the following detailed description, which, taken in conjunction with the annexed drawings, disclose a preferred embodiment of the invention.

BRIEF DESCRIPTION OF THE DRAWINGS

Referring now to the drawings which form a part of this original disclosure.

DETAILED DESCRIPTION OF THE INVENTION

Figure 1:
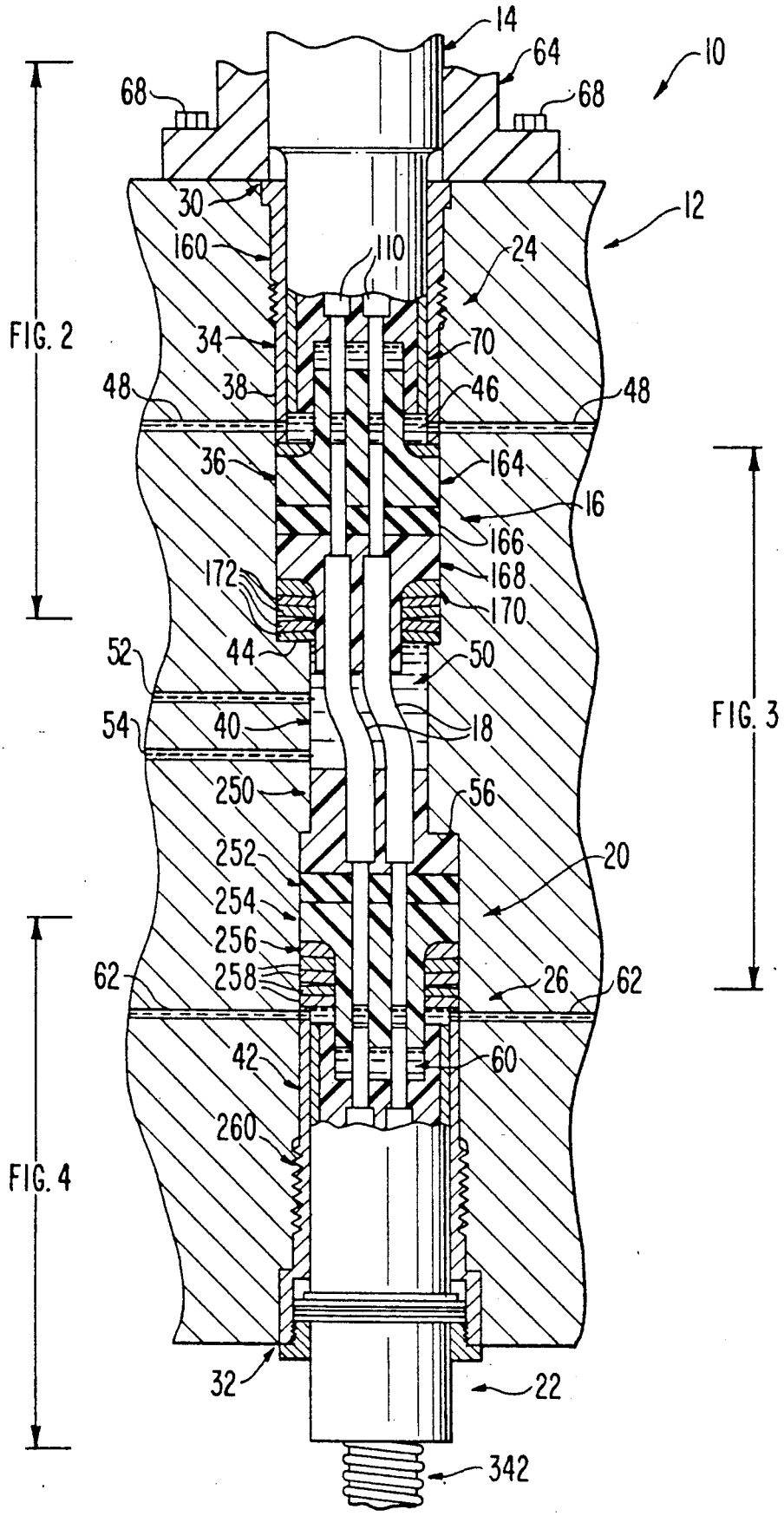
FIG. 1 is a front elevational view in partial section showing an electrical coupling assembly in accordance with the present invention for conducting electricity between areas of different pressures.

Initially referring to FIG. 1, an electrical coupling assembly 10 in accordance with the present invention is illustrated, and includes a hollow housing or tubing hanger 12 extending between two areas of different pressures, an upper electrical cable connector 14 slidably coupled within the upper end of hollow housing 12, an upper penetrator assembly 16 located in housing 12, three equally spaced apart electrical interconnecting members or conductors 18 (only two shown in FIG. 1) located in housing 12, a lower penetrator assembly 20 located in housing 12, and a lower electrical cable connector 22 slidably coupled within the lower end of housing 12.

Preferably, electrical coupling assembly 10 is utilized for transmitting electrical power from an oil rig above the ocean, to the subsea wellhead mounted on the ocean floor. Basically, tubing hanger 12 is housed in the subsea wellhead with the electricity or power being transmitted to the top of tubing hanger 12 by an electrical cable having upper electrical connector 14 coupled thereto. Then, the electricity is transmitted through tubing hanger 12 via upper penetrator assembly 16, electrical conductors 18, and lower penetrator assembly 20, to the lower end of tubing hanger 12. Lower electrical connector 22 is coupled to the lower end of tubing hanger 12 for transmitting the power from electrical conductors 18 to an electrical cable coupled between lower electrical connector 22 and an electrical, submersible pump. Accordingly, electrical coupling assembly 10 conducts or transmits electrical power between two areas of different pressures, i.e., the ocean pressure acting on the top of tubing hanger 12 and the oil pressure acting on the bottom of tubing hanger 12.

Connectors 14 and 22 carry electricity from one area to another area, where the pressure gradient between the two areas is less than 25 psi. Penetrator assemblies 16 and 20, on the other hand, carry electricity from one area to another area, where a large pressure gradient exists between the two areas, i.e., a pressure gradient greater than 25 psi.

Electrical coupling assembly 10 has the longitudinal axes of the upper connector 14 and upper penetrator assembly 16 offset from the longitudinal axes of the lower connector 22 and lower penetrator assembly 20. This arrangement allows greater flexibility in designing electrical coupling assembly 10 so that the electrical cables do not interfere with other components, such as production tubing and hydraulic control lines, passing through the hanger.

Also, electrical coupling assembly 10 has the penetrator assemblies 16 and 20 arranged to provide redundant sealing for preventing oil well fluids from leaking out of the oil well. In particular, if oil well fluids were to leak into the electrical coupling assembly 10, then the pressure of the oil well fluids would act on the penetrator assemblies 16 and 20, in such a manner as discussed below, to further compress the seals therein to prevent oil well fluids from leaking into the environment.

Hollow Housing 12

Hollow housing, or tubing hanger, 12 has a first open end 30 and a second open end 32 with a continuous bore 34 extending between first and second open ends 30 and 32. Bore 34 has a tubular inner surface 36, and includes an upper tubular section 38, a central tubular section 40 and a lower tubular section 42. Housing 12 is preferably made of any suitable hard, rigid material such as steel. While the hollow housing 12 is illustrated as a tubing hanger, it should be apparent that the hollow housing could be a packer or a part of any system that conducts electricity between two areas of different pressures.

The longitudinal axes of upper, central and lower tubular sections 38, 40 and 42 are offset from each other. This allows for greater flexibility in positioning the upper and lower electrical cable connectors 14 and 22 in the oil well, since the upper and lower electrical cable connectors 14 and 22 do not need to be aligned along a common axis.

Figure 2:
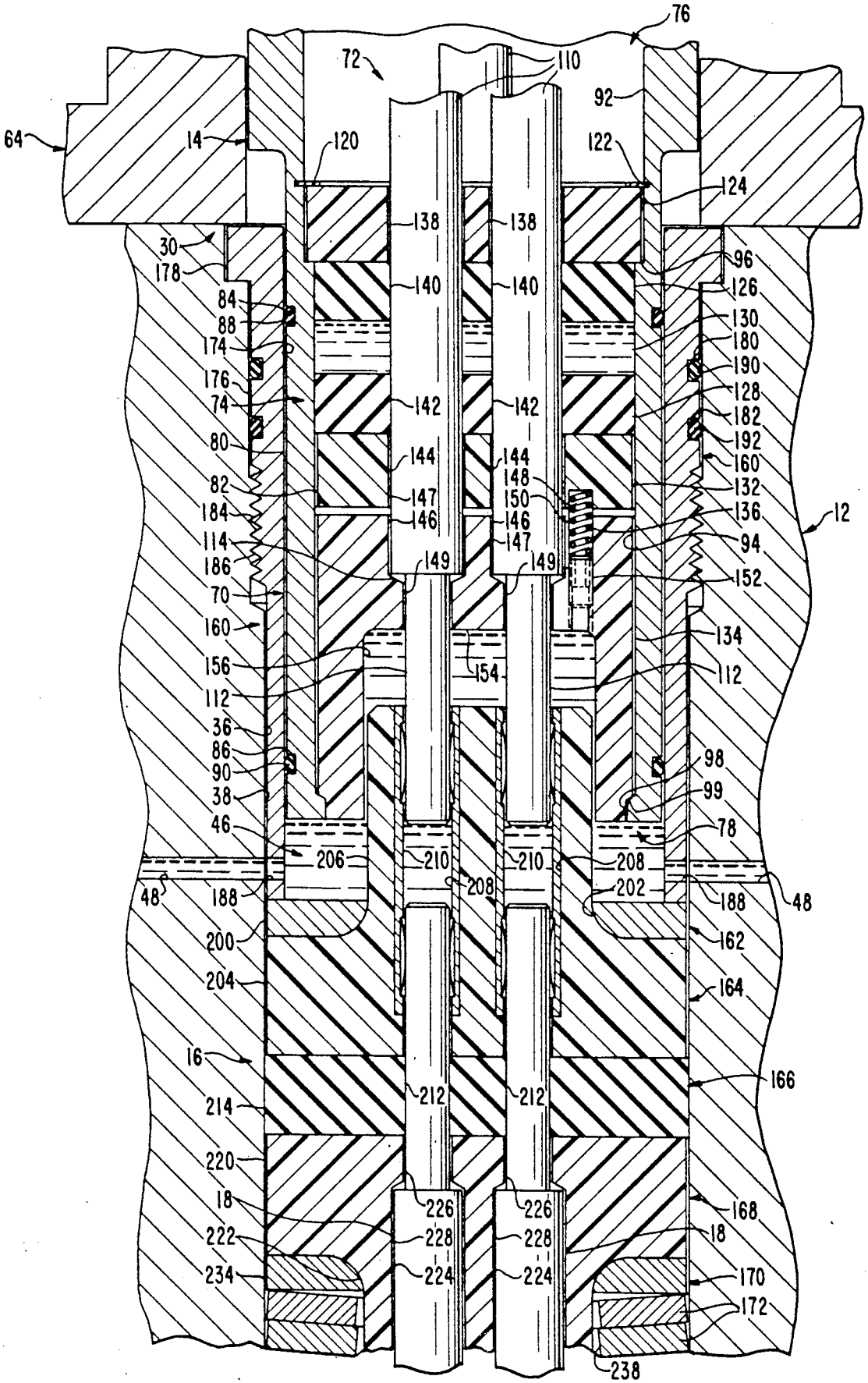
FIG. 2 is an enlarged, front elevational view in partial section of the present invention showing the electrical coupling assembly in more detail as depicted in the upper third of FIG. 1.
Figure 3:
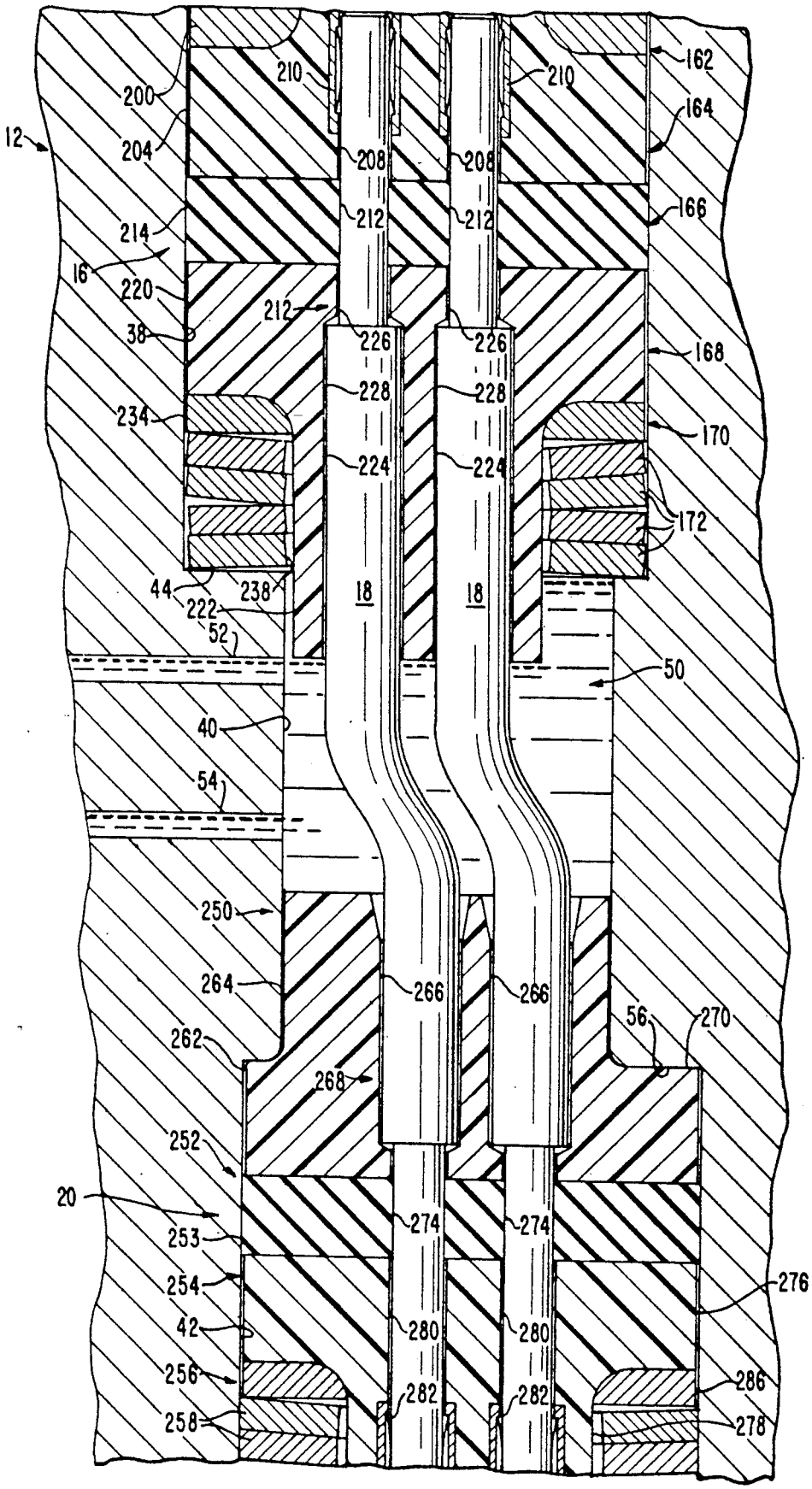
FIG. 3 is an enlarged, front elevational view in partial section of the present invention showing the electrical coupling assembly in more detail as depicted in the center of FIG. 1.

Referring to FIGS. 2 and 3, upper tubular section 38 is preferably cylindrical with a diameter of about three inches and extends from first open end 30 to an axially, upwardly facing annular shoulder 44. Upper electrical cable connector 14 and upper penetrator assembly 16 are located in upper tubular section 38 and separated by a flowable material 46 such as a substantially incompressible dielectric grease or oil. Flowable material 46 fills the otherwise empty spaces between upper electrical cable connector 14 and upper penetrator assembly 16. A plurality of bleed ports 48 extend radially through housing 12 into upper tubular section 38 between upper electrical connector 14 and upper penetrator assembly 16 for removing air and excess flowable material 46 during purging of upper tubular section 38.

Upper electrical connector 14, upper penetrator assembly 16 and flowable material 46 together form a first or upper pressure-equalizing assembly 24 which maintains the pressure inside housing 12 equal to or greater than the pressure acting on the first end 30 of housing 12. This is basically accomplished by filling the otherwise empty spaces between upper connector 14 and upper penetrator assembly 16 with flowable material 46, and having upper connector 14 exposed to the downward, external pressure on first open end 30 and slidably mounted in housing 12 to pressurize flowable material 46.

Referring now to FIG. 3, central tubular section 40 is preferably cylindrical with a diameter of about two inches and interconnects upper tubular section 38 and lower tubular section 42 to form a continuous bore 34 between first and second open ends 30 and 32. Electrical interconnecting members or conductors 18 pass from upper tubular section 38 through central tubular section 40 and into lower tubular section 42 for conducting electricity between upper electrical cable connector 14 and lower electrical cable connector 22.

Central tubular section 40 is filled with a flowable material 50, such as substantially incompressible dielectric grease or oil. Flowable material 50 fills all of the otherwise empty spaces inside central tubular section 40 between upper penetrator assembly 16 and lower penetrator assembly 20. Upper and lower bleed ports 52 and 54, respectively, extend radially through housing 12 into central tubular section 40 for purging central tubular section 40 of any air or excess flowable material 50.

Figure 4:
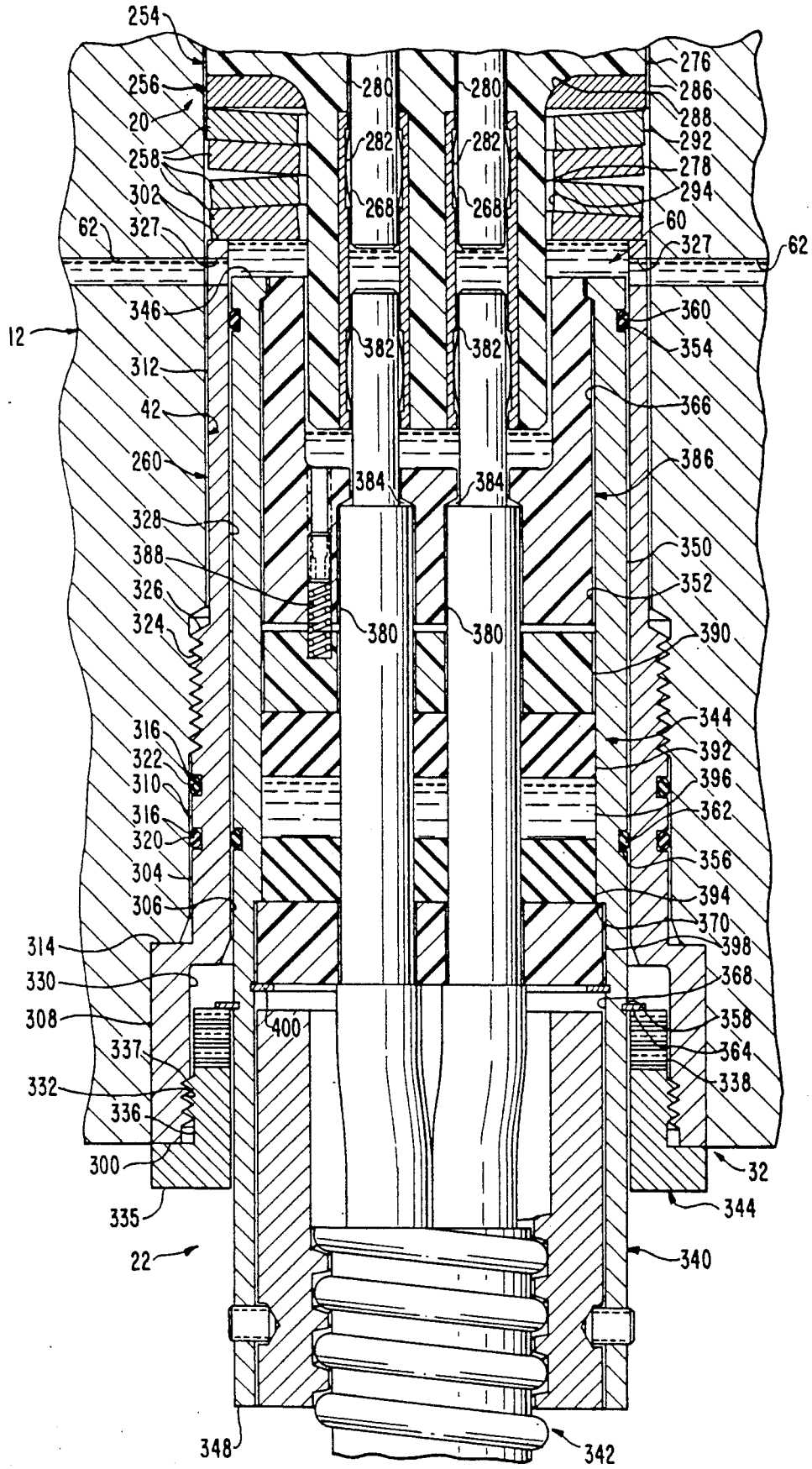
FIG. 4 is an enlarged, front elevational view in partial section of the present invention showing the electrical coupling assembly in more detail as depicted in the bottom third of FIG. 1.

Referring now to FIGS. 3 and 4, lower tubular section 42 is preferably cylindrical with a diameter of about three inches and has its longitudinal axis offset from the longitudinal axes of upper tubular section 38 and central tubular section 40. Lower tubular section 42 extends between second open end 32 and an axially, downwardly facing annular abutment shoulder 56. Lower penetrating assembly 20 and lower electrical cable connector 22 are both located in lower tubular section 42.

A flowable material 60, such as substantially incompressible dielectric grease or oil, is located in lower tubular section 42 between lower penetrator assembly 20 and lower electrical cable connector 22. Flowable material 60 fills the otherwise empty spaces between lower penetrator assembly 20 and lower electrical cable connector 22. A plurality of bleed ports 62 extend radially through housing 12 into lower tubular section 42 between lower penetrator assembly 20 and lower electrical cable connector 22 for purging any air and excess flowable material 60 from lower tubular section 42.

Lower electrical cable connector 22, lower penetrator assembly 20 and flowable material 60 together form a second, or lower, pressure-equalizing assembly 26 which maintains the pressure inside lower tubular section 42 of housing 12 equal to or greater than the pressure acting on the second end 32 of housing 12. This is basically accomplished by filling the otherwise empty spaces between lower connector 22 and lower penetrator assembly 20 with flowable material 60, and having lower connector 22 exposed to the upward, external pressure on second open end 32 for pressurizing the flowable material 60.

Upper Electrical Cable Connector 14

Referring again to FIGS. 1 and 2, upper electrical cable connector 14 is slidably coupled to housing 12 via a metallic anchor 64 which is rigidly coupled to housing 12 via suitable fasteners 68 such as a plurality of bolts. Since anchors, such as anchor 64 are well known, anchor 64 will not be described or shown in detail. Upper electrical cable connector 14 includes a substantially cylindrical hollow housing 70, an electrical cable 72 with a portion located in housing 70, and a sealing assembly 74 located in housing 70 for sealing the space between housing 70 and the portion of cable 72 located in housing 70.

Upper electrical cable connector 14 is substantially identical to the electrical cable connector disclosed in U.S. Pat. No. 4,927,386 to David H. Neuroth, which is incorporated herein by reference. Accordingly, upper electrical cable connector 14 will only be briefly discussed herein.

As seen in FIG. 2, housing 70 has first and second open ends 76 and 78 with a longitudinal axis extending therebetween and a substantially cylindrical outer surface 80 and a substantially cylindrical inner surface 82. Housing 70 is preferably made of any suitable rigid, metallic material such as steel. Outer surface 80 has a pair of annular recesses 84 and 86 for receiving elastomeric O-rings 88 and 90, respectively, therein. Inner cylindrical surface 82 includes a first cylindrical portion 92 and a second cylindrical portion 94. First cylindrical portion 92 has a greater diameter than second cylindrical portion 94 and has an axially-facing annular shoulder 96 extending radially inwardly from its inner surface to the inner surface of the second cylindrical portion 94. Second cylindrical portion 94 includes an inwardly extending circumferential flange 98 adjacent second open end 78 with an axially-facing annular shoulder 99 facing towards first open end 76 of housing 70.

Electrical cable 72 is preferably a reinforced electrical cable with three electrical conductors 110, such as the electrical cable disclosed in U.S. Pat. No. 4,675,474 to David H. Neuroth, which is incorporated herein by reference. Since cable 72 is well known in the art, it will not be illustrated or described in detail herein.

Electrical conductors 110 each have a copper core 112 surrounded by a layer of elastomeric insulation 114. The insulation 114 is preferably formed of an ethylene propylene dimonomer (EPDM) and can be coated with a polymeric chemical barrier on its outer surface such as that sold under the trademark KYNAR to protect the conductors 110 from corrosion. Each conductor 110 has a portion of insulation 112 removed at its end to expose copper core 112.

Referring to FIG. 2, sealing assembly 74 includes a metallic retaining ring 120 rigidly coupled in an annular groove 122 formed in first cylindrical portion 92, a top compression disk 124 rigidly coupled between retaining ring 120 and annular shoulder 96, a pair of rubber seals 126 and 128 located in second cylindrical portion 94, a flowable rubber seal 130 located between rubber seal 126 and 128, a movable middle compression disk 132 abutting against rubber seal 128 in second cylindrical portion 94, a bottom compression disk 134 located in second cylindrical portion 94 between middle disk 132 and abutting annular shoulder 99, and three compression springs 136 (only one shown) engaging middle disk 132 and bottom disk 134 for compressing seals 126, 128 and 130.

Top compression disk 124 is preferably made of a dielectric glass reinforced polymeric material, such as polyetheretherketone (PEEK) or any other suitable dielectric material. Top compression disk 124 has a substantially cylindrical outer shape with three axially extending holes 138 (only two shown) for receiving a portion of insulated conductors 110 therethrough. The holes 138 are preferably arranged 120° apart. Top compression disk 124 is rigidly coupled to housing 70 by retaining ring 120 which holds top compression disk 124 against shoulder 96.

Rubber seals 126 and 128 are preferably made of fully cured (i.e., vulcanized or cross linked) rubber or elastic material such as ethylenepropylene dimonomers (EPDM). Rubber seals 126 and 128 each preferably have a substantially cylindrical outer shape and three axially extending holes 140 and 142 (only two shown), respectively, for receiving a portion of insulated conductors 110 therethrough. The holes 140 and 142 are preferably arranged 120° apart. The diameters of holes 140 and 142 are preferably slightly smaller than the outer diameter of insulated conductors 110 to form a slight interference fit therebetween. The outer diameters of rubber seals 126 and 128 are preferably slightly greater than the diameter of the inner surface 82 at second cylindrical portion 94 of housing 70 to form a slight interference fit therebetween.

Flowable rubber seal 130 is preferably made of a synthetic rubber compound such as ethylene propylene monomers (EPM), ethylene propylene dimonomers (EPDM), olefins, silicone rubbers or fluorinated rubbers, and is advantageously incompressible and dielectric.

In any case, the flowable rubber seal 130 is made of a material such that it will flow under the pressure of springs 136 to seal any otherwise empty spaces between conductors 110 and seals 126 and 128, and housing inner surface 82 and the seals 126 and 128, but will not flow out of sealing assembly 74.

Movable middle disk 132 and bottom disk 134 can be made of a dielectric glass reinforced polymeric material, such as polyetheretherketone (PEEK) or any other suitable dielectric material. Middle and bottom disks 132 and 134 each have a substantially cylindrical outer shape and three axially extending holes 144 and 146, respectively, for receiving the insulated conductors 110 therethrough. The holes 144 and 146 are arranged 120° apart. Holes 146 having a first cylindrical portion 147 and a second cylindrical portion 149. First portion 147 of holes 146 has an inner diameter which is slightly larger than insulated conductors 110. Second portion 149 of holes 146 has an inner diameter which is smaller than the diameter of first portion 147 and slightly larger than the outer diameter of core 112 of conductors 110.

The middle and bottom disks 132 and 134 also have three axially extending bores (only one shown) 148 and 150 positioned in their adjacent walls each for receiving and retaining one end of the compression springs 136 therein. Bores 148 extend only partially into middle disk 132 for abutting one end of springs 136, while bores 150 extend completely through bottom disk 134 and is threaded for threadedly receiving a threaded plug 152 therein. Plug 152 permits adjustment of the amount of compression transmitted by compression springs 136 to rubber seals 126, 128 and 130.

Bottom disk 134 has an end wall 154 with a central bore 156 for receiving a portion of upper penetrator assembly 16 therein.

Upper Penetrator Assembly 16

Referring now to FIGS. 2 and 3, upper penetrator assembly 16 includes upper compression bushing 160 rigidly coupled to housing 12, a stationary transition ring 162, a stationary upper packing disk 164, an upper sealing disk 166, a movable upper packing disk 168, a movable transition ring 170 and a series of Belleville spring washers 172.

Upper compression bushing 160 is substantially cylindrical and has a substantially cylindrical inner surface 174 and a substantially cylindrical outer surface 176. Preferably, upper compression bushing 160 is made of any suitable rigid metallic material, such as steel.

Inner surface 174 is substantially smooth for permitting upper electrical cable connector 14 to freely slide longitudinally therein. O-rings 88 and 90, on the outer surface 80 of housing 70, sealingly engage inner surface 174 of compression bushing 160 to prevent inward infiltration of contaminants, due to the pressure of the ocean, and outward flow of the flowable material 46 in upper tubular section 38 between housing 70 and compression bushing 160, due to the pressure of upper connector 14 on flowable material 46.

Outer surface 176 of compression bushing 160 includes an annular outwardly extending flange 178, a pair of annular recesses 180 and 182, and a section of external threads 184 that threadedly engages internal threads 186 of upper tubular section 38 of housing 12. Thus, compression bushing 160 is releasably and rigidly coupled to housing 12 via threads 184 and 186.

Compression bushing 160 also includes a plurality of radially extending bores 188 which are aligned with bleed ports 48 when coupled to housing 12 for permitting grease and/or air to flow therethrough.

A pair of O-rings 190 and 192 are received in annular recesses 180 and 182, respectively, and engage tubular inner surface 36 of upper tubular section 38 of housing 12 for sealing the space therebetween. Thus, O-rings 190 and 192 prevent inward infiltration of contaminants and outward flow of the flowable material 46 in upper tubular section 38 between housing 12 and compression bushing 160.

Stationary transition ring 162 is preferably made of a metallic material such as steel, and has a substantially cylindrical outer surface 200 and an inner central bore 202. The outer diameter of outer surface 200 is preferably slightly smaller than the inner diameter of upper tubular section 38 of housing 12.

Stationary packing disk 164 is preferably made of polyetheretherketone (PEEK), or other suitable dielectric material, and includes a first substantially cylindrical portion 204 and a second substantially, cylindrical portion 206 integrally formed with first cylindrical portion 204 and extending coaxially upwardly from first portion. First portion 204 has an outer diameter slightly smaller than the inner diameter of upper tubular section 38 of housing 12. Second portion 206 has an outer diameter slightly smaller than bore 156 of end wall 154 to be slidably received within bore 156.

Stationary packing disk 164 also includes three cylindrical bores 208 (only two shown), each having a multiple contact band connector 210 rigidly secured therein. Bores 208 are spaced 120° apart and receive copper conductors 112 of cable 72 and the portion of the upper connecting ends 212 of electrical interconnecting members, or conductors, 18 which have been stripped of their insulation layer.

Multiple contact band connectors 210 are preferably made of a highly conductive metallic material such as gold plated stainless steel such as those sold by Hugin Industries, Inc. Connectors 210 electrically connect upper electrical cable connector 14 to electrical interconnecting members, or conductors, 18. Since multiple contact band connectors, such as connectors 210, are conventional, they will not be discussed in detail.

Sealing disk 166 preferably has a substantially cylindrical outer surface 214 having an outer diameter which is slightly larger than the inner diameter of upper tubular section 38 of housing 12 to form a slight interference fit therebetween. Sealing disk 166 also includes three axially extending bores 216 (only two shown) which are spaced 120° apart for receiving a portion of upper connecting ends 212 of conductors 18 therethrough. Bores 216 have an inner diameter which is slightly smaller than the outer diameter of the copper core of upper connecting ends 212 of conductors 18 for creating an interference fit therebetween. Preferably, upper sealing disk 166 is made from ethylene propylene dimonomers (EPDM).

Movable packing disk 168 has a first substantially cylindrical portion 220 and a coaxial second substantially cylindrical portion 222 extending coaxially downwardly therefrom. Three bores 224 (only two shown) extend axially through movable packing disk 168 for receiving a portion of upper connecting ends 212 of conductors 18 therethrough. Bores 224 are spaced 120° apart, and include a first cylindrical portion 226 and a second cylindrical portion 228 having a larger diameter than first cylindrical portion 226. First cylindrical portions 226 have their inner diameters slightly larger than the copper cores of upper connecting ends 212 of conductors 18. Second cylindrical portions 228 have their inner diameter slightly larger than the insulated portion of conductors 18.

Movable transition ring 170 is substantially identical to stationary transition ring 162 except it is facing in the opposite direction. Movable transition ring 170 includes a substantially cylindrical outer surface 234 having an outer diameter which is slightly smaller than the inner diameter of upper tubular section 38, and an inner central bore 236 having an inner diameter which is sized to receive inner cylindrical portion 222 of movable packing disk 168. Preferably, transition ring 170 is made of a metallic material, such as steel.

Belleville spring washers 172 have a substantially cylindrical outer surface 237 which is slightly smaller than the inner diameter of upper tubular section 38, and a bore 238 with its inner diameter slightly larger than the cylindrical portion 222 of movable packing disk 168.

Compression bushing 160 and Belleville spring washers 172 act together to exert an axially directed compression force on sealing disk 166. Advantageously, sealing disk 166 is pre-loaded by the compression force to about 1,000 psi to about 5,000 psi to about 75° F.

In assembling upper penetrator assembly 16, first Belleville spring washers 172 are inserted into upper tubular section 38 until the lowermost Belleville spring washer contacts and rests upon annular shoulder 44. Next, movable transition ring 170 is inserted into upper tubular section 38 and rests upon the uppermost Belleville spring washer.

Now, upper penetrator assembly 16 is assembled and coupled to upper connected ends 212 of conductors 18 and inserted into upper tubular section 38. In particular, second cylindrical portion 222 of movable packing disk 168 extends downwardly through bore 236 of movable transition ring 170 and through bores 238 of Belleville spring washers 172. Bores 224 of packing disk 168 also receive a portion of upper connecting ends 212 of conductors 18. Upper sealing disk 166 contacts movable packing disk 168 and has a portion of the upper connecting ends 212 of conductors 18 extending through bores 216 of sealing disk 166. Stationary packing disk 164 has its second cylindrical portion 206 extending upwardly and its bores 208 receiving a portion of the upper connecting ends 212 of conductors 18 therein. Retaining ring 162 encircles second cylindrical portion 206 of stationary packing disk 164 and abuts the upwardly facing shoulder of first cylindrical portion 204 of stationary packing disk 164. Upper compression bushing 160 is threaded into upper tubular section 38 with its lower end engaging retaining ring 162, which causes stationary packing disk 164, upper sealing disk 166, movable packing disk 168, and movable transition ring 170 to move longitudinally downwardly and compress Belleville spring washers 172. Accordingly, Belleville spring washers 172 exert a compressive force onto sealing disk 166 to ensure an effective seal between housing 12 and sealing disk 166 and sealing disk 166 and connecting ends 212 of conductors 18. Advantageously, the Belleville spring washers 172 can provide a pre-load compression force of about b 1,000 psi to about 5,000 psi at about 75° F.

Lower Penetrator Assembly 20

Referring now to Figs. 3 and 4, lower penetrator assembly 20 includes stationary lower packing disk 250, a lower sealing disk 252, a movable lower packing disk 254, a movable transition ring 256, a series of Belleville spring washers 258 and a lower compression bushing 260.

Stationary lower packing disk 250 includes a first substantially cylindrical portion 262 and a second substantially cylindrical portion 264 extending upwardly from first cylindrical portion 262, and three axially extending bores 266 (only two shown) for receiving a portion of lower connecting ends 268 of conductors 18. An annular abutment shoulder 270 is formed between first cylindrical portion 262 and second cylindrical portion 264 for contacting annular abutment shoulder 56. Accordingly, second cylindrical portion 264 has an outer diameter which is slightly smaller than the inner diameter of central tubular section 40 for being received therein, while outer cylindrical portion 262 has a first diameter which is slightly smaller than the inner diameter of lower tubular section 42. Preferably, stationary packing disk 250 is made of polyetheretherketone (PEEK) or other suitable dielectric material.

Lower sealing disk 252 preferably has a substantially cylindrical outer surface 253 which is slightly larger than the inner cylindrical surface of lower tubular section 42 for forming an interference fit therebetween. Sealing disk 252 also includes three axially extending bores 274 (only two shown) which are spaced 120° apart for receiving a portion of lower connecting ends 268 of conductors 18 therethrough. Bores 274 have their inner diameters slightly smaller than the outer diameter of the copper of conductors 18 at lower connecting ends 268 to form an interference fit therebetween. Preferably, lower sealing disk 252 is made of a sealing material such as ethylene propylene dimonomers (EPDM).

Movable lower packing disk 254 includes a first substantially cylindrical portion 276 and a second substantially cylindrical portion 278 extending coaxially downwardly from first portion 276. Three axially extending bores 280 (only two shown) which are spaced about 120° apart extend axially through lower packing disk 254. Preferably, movable lower packing disk 252 is made of polyetheretherketone (PEEK) or other suitable dielectric material.

Each of the bores 280 has a multiple contact band connector 282 rigidly coupled therein. Multiple contact band connectors 282 are preferably made of gold plated stainless steel such as those sold by Hugin Industries, Inc. Connectors 282 electrically connect electrical interconnecting members, or conductors, 18 to lower dielectrical cable connector 22. Since multiple contact band connectors, such as connectors 282, are conventional, they will not be discussed in detail.

Movable transition ring 256 has a substantially cylindrical outer surface 286 with its outer diameter slightly smaller than the inner diameter of lower tubular section 42 and an inner central bore 288 with an inner diameter slightly larger than the outer diameter of second cylindrical portion 278 of movable packing disk 254 for receiving second cylindrical portion 278 therein. Preferably, movable transition ring 256 is made of a hard, rigid metallic material, such as steel or any other suitable material.

Belleville spring washers 258 have a substantially cylindrical outer surface 292 which is slightly smaller than the inner diameter of lower tubular section 42, and a central bore 294 with its inner diameter slightly larger than the second cylindrical portion 278 of movable packing disk 254.

Referring now to FIG. 4, lower compression bushing 260 is tubular with a first open end 300 and a second open end 302. Compression bushing 260 has a substantially cylindrical outer surface 304 and a substantially cylindrical inner surface 306. Preferably, lower compression bushing 260 is made of a metallic material or any other hard, rigid material.

Compression bushing 260 and Belleville spring washers 258 act together to exert an axially directed compression force on sealing disk 252. Advantageously, sealing disk 252 is pre-loaded by the compression force to about 1,000 psi to about 5,000 psi at about 75° F.

Outer surface 304 includes a first cylindrical portion 308, a second cylindrical portion 310 and a third cylindrical portion 312. First cylindrical portion 308 has a larger outer diameter than second cylindrical portion 310, and thus forms an upwardly facing annular abutment surface 314 which extends between first cylindrical portion 308 and second cylindrical portion 310. Second cylindrical portion 310 includes a pair of annular recesses 316 and 318 for receiving elastomeric O-rings 320 and 322, respectively, therein. Second cylindrical portion 310 also includes a section of external threads 324 which threadedly engage internal threads 326 of lower tubular section 42 of housing 12 for rigidly and releasably coupling lower compression bushing 260 to housing 12. Third cylindrical portion 312 has a plurality of bores 327 extending between outer surface 304 and inner surface 306 for fluidly connecting bleed ports 62 to lower tubular section 42.

Inner surface 306 of compression bushing 260 includes an upper substantially cylindrical portion 328 for slidably receiving lower electrical cable connector 22 therein, and a lower substantially cylindrical portion 330 having a larger inner diameter than the inner diameter of upper cylindrical portion 328. Lower cylindrical portion 330 includes a section of internal threads 332 for threadedly engaging locking ring 334.

In assembling lower penetrator assembly 20, first stationary packing disk 250, lower sealing disk 252 and movable packing disk 254 are inserted into lower tubular section 42 of housing 12 with the lower connecting ends 268 of conductors 18 extending through their respective axially extending bores. Next, Belleville spring washers 258 are inserted into lower tubular section 42 of housing 12, and compression bushing 260 is inserted and threaded into lower tubular section 42 of housing 12 to compress sealing disk 252.

Locking ring 334 is tubular, and has an annular flange 335 and a cylindrical portion 336 with external threads 337 thereon. Locking ring 334 is threadedly coupled to compression bushing 260 via internal threads 332 and external threads 337 for releasably coupling lower electrical cable connector 22 in housing 12. In particular, a wave spring 338 is positioned between locking ring 334 and a portion of lower electrical cable connector 22 for slidably and releasably coupling lower electrical cable connector 22 to compression bushing 260. Accordingly, lower electrical cable connector 22 is initially biased upwardly and prevented from coming out of housing 12 by locking ring 334 and wave spring 338.

Lower Electrical Cable Connector 22

Lower electrical cable connector 22 is slidably coupled in lower tubular section 42 of housing 12, and includes a substantially cylindrical hollow housing 340, an electrical cable 342 rigidly coupled to housing 340 and a sealing assembly 344 located in housing 340. Lower electrical cable connector 22 is substantially identical to upper electrical cable 14, except that housing 340 has been slightly modified. Moreover, lower electrical cable connector 22 is substantially identical to the electrical cable connector disclosed in U.S. Pat. No. 4,927,386 to David H. Neuroth, which has been incorporated herein by reference. Accordingly, lower electrical cable connector 22 will only be briefly discussed herein.

Housing 340 has a first open end 346 and a second open end 348 with a portion of cable 342 being located therein. Housing 340 also includes a substantially cylindrical outer surface 350 and a substantially cylindrical inner surface 352. Outer surface 350 includes three annular recesses 354, 356, and 358. Recesses 354 and 356 receive elastomeric O-rings 360 and 362, respectively, while recess 358 receives a metallic retaining ring 364. O-rings 360 and 362 sealingly engage inner surface 306 of compression bushing 260 to prevent inward infiltration of contaminants and outward flow of the flowable material 60 in lower tubular section 42 between housing 340 and compression bushing 260.

Inner surface 352 includes a first cylindrical portion 366 and a second cylindrical portion 368. Second cylindrical portion 368 has a greater diameter than second cylindrical portion 366 and forms an axially-facing circumferential shoulder 370 extending radially inwardly from the inner surface of second cylindrical portion 368 to the inner surface of first cylindrical portion 366. First cylindrical portion 366 has an inwardly extending flange 373 adjacent its first open end 346. Flange 373 has an axially-facing annular shoulder 374. First cylindrical portion 366 has an annular groove 376 for receiving a metallic retaining ring 378.

Electrical cable 342 has three electrical conductors 380 (only two shown) with each conductor 380 having a copper core 382 covered with a layer of elastomeric insulation 384. The insulation 384 is preferably formed of an ethylene propylene dimonomer (EPDM) and can be coated with a polymeric chemical barrier on its outer surface such as that sold under the trademark KYNAR to protect the conductors 380 from corrosion. Each conductor 380 has a portion of insulation 384 removed at its end to expose copper core 382. Cable 342 is substantially identical to cable 72 of upper electrical cable connector 14 and to the electrical cable disclosed in U.S. Pat. No. 4,675,474 to David H. Neuroth, which is incorporated herein by reference. Accordingly, cable 342 will not be illustrated or discussed in detail herein.

Sealing assembly 344 includes a top compression disk 386, three compression springs 388 (only one shown), a movable middle disk 390, a pair of rubber seals 392 and 394, a flowable rubber seal 396 positioned between rubber seal 392 and 394, a bottom compression disk 398, and metallic retaining ring 400. Sealing assembly 344 is substantially identical to sealing assembly 74, and thus will not be discussed in detail.

Assembly

In assembling electrical coupling assembly 10, first the three electrical interconnecting members, or conductors, 18 are prepared for insertion into central tubular section 40 of hollow housing, or tubing hanger 12. In particular, conductors 18 should have the insulation and chemical barrier layer removed to expose about five inches of the copper core on the upper connecting ends 212 and about seven inches of the copper core on the lower connecting ends 268. Preferably, the upper and lower connecting ends 212 and 268 of the conductors 18 are than filed to square the ends of solid copper core and form a 1/32×45° chamfer on the connecting ends 212 and 268. The conductors 18 also should be bent prior to insertion to conform to the offset between longitudinal axes of the upper tubular section 38 and lower tubular section 42.

After the conductors 18 have been prepared for insertion, Belleville spring washers 172 and transition ring 170 are inserted into the upper tubular section 38 where they are supported by annular shoulder 44. Next, the movable upper packing disk 168, upper sealing disk 166 and stationary upper packing disk 164 are assembled together and installed on the upper connecting ends 212 of conductors 18. Now, this entire assembly is inserted into bore 34 of housing 12 with conductors 18 spanning upper, central and lower tubular sections 38, 40 and 42 of housing 12 and with disks 164, 166 and 168 resting on transition ring 170. Next, transition ring 162 and upper compression bushing 160 are inserted into upper tubular section 38 of housing 12. The upper compression bushing 160 is tightened down to compress upper sealing disk 166 and the series of Belleville spring washers 172. This completes the upper penetrator assembly 16.

Next, the housing or tubing hanger 12 is turned upside down and the central tubular section 40 is filled with dielectric grease. Then, stationary lower packing disk 250, lower sealing disk 252 and movable lower packing disk 254 are all inserted into lower tubular section 42 and over the lower connecting ends 268 of conductors 18. Then, movable transition ring 256, Belleville spring washers 258 and lower compression bushing 260 are inserted into lower tubular section 42, and then the lower compression bushing 260 is tightened down to compress lower sealing disk 252 and the series of Belleville spring washers 258. This completes the lower penetrator assembly 20.

Now all remaining spaces between open ends 30 and 32 of housing 12 and the penetrator assemblies 16 and 20 are filled with dielectric grease 46 and 60, respectively, via ports 48 and 62. The open ends 30 and 32 of housing 12 can now be closed off for shipping the partially assembled assembly to the oil well.

To ensure that the central tubular section 40 is free of air pockets, the central tubular section 40 is purged by injecting new dielectric grease into central tubular section 40 through lower bleed port 54 while the upper bleed port 52 is open. This will permit air pockets and excess grease to be expelled from central tubular section 40 through upper bleed port 52. Finally, bleed ports 52 and 54 are closed after completing the purging operation by, for example, conventional plugs.

This completes the assembly of the penetrators in the subsea well head tubing hanger 12. Connection of the upper and lower electrical cable connectors 14 and 22 can be performed offshore on the drill rig when the electrical coupling assembly 10 is being installed into the well.

At the offshore oil rig, upper electrical cable connector 14 is attached to the cable 72 and mounted in the cable anchor 64. Then, lower electrical cable connector 22 is assembled on top of electrical submersible pump cable when running the assembly.

Now, the upper shipping cap is removed from the open end 30 of tubing hanger 12 and the bleed ports 48 are opened to allow excess grease to be expelled from the upper tubular section 38 when electrical cable connector 14 is inserted therein. The cable anchor 64 is then firmly locked to housing 12 and bleed port 48 is then closed. Now, a temporary shear screw (not shown) is removed to let the upper electrical cable connector 14 to float freely in a piston-like fashion. This will ensure that pressure is balanced across the connector 14.

Now, the bottom shipping cap from the tubing hanger 12 is removed and the bleed ports 62 are opened. Lower electrical cable connector 22 is then gradually inserted into lower tubular section 42. During this operation excess dielectric grease will be expelled from the lower tubular section 42 out of bleed port 62. Finally, the lower connector locking ring 334 is firmly tightened to lower compression bushing 260 and bleed ports 62 are closed by, for example, conventional plugs. The electric coupling assembly 10 can now be run into the well and locked into the subsea tree of the oil well.

While only one embodiment has been chosen to illustrate the invention, it will be understood by those skilled in the art that various changes and modifications can be made herein without departing from the scope of the invention as defined in the appended claims.

What is claimed is:

1. An electrical coupling assembly for conducting electricity between areas of different pressures, the combination comprising:

a hollow housing having first and second open ends, and an inner tubular surface, said first and second open ends being located respectively in areas of different pressures;

interconnecting means, located in said housing, for conducting electricity between said first and second open ends of said housing, said interconnecting means having a first connecting end with a first portion located completely in said housing between said first and second open ends, said first portion having a first longitudinal axis, and a second connecting end with a second portion located completely in said housing between said first and second open ends, said second portion having a second longitudinal axis which is offset from said first longitudinal axis, said first and second longitudinal axes being substantially parallel;

first sealing means, located in said housing and engaging said inner surface of said housing, for sealing said housing and said interconnecting means adjacent said first open end of said housing; and second sealing means, located in said housing and engaging said inner surface of said housing, for sealing said housing and said interconnecting means adjacent said second open end of said housing, said first portion and said second portion being located between said first and second sealing means.

2. An electrical coupling assembly according to claim 1, wherein said inner tubular surface of said housing includes a first tubular section having a longitudinal axis, and a second tubular section having a longitudinal axis offset from said longitudinal axis of said first tubular section.

3. An electrical coupling assembly according to claim 2, wherein said first and second tubular sections are connected by a central tubular section filled with substantially incompressible, dielectric flowable material.

4. An electrical coupling assembly according to claim 2, further comprising first pressure-equalizing means, coupled to said first open end of said housing, for maintaining the pressure inside said housing on said first sealing means at least equal to the pressure acting on said first open end of said housing, and second pressure-equalizing means, coupled to said second open end of said housing, for maintaining the pressure inside said housing on said second sealing means at least equal to the pressure acting on said second open end of said housing.

5. An electrical coupling assembly according to claim 4, wherein said first pressure-equalizing means includes a first longitudinally movable member exposed to the pressure acting on said first open end of said housing, and said second pressure-equalizing means includes a second longitudinally movable member exposed to the pressure acting on said second open end of said housing.

6. An electrical coupling assembly according to claim 5, wherein said first pressure-equalizing means further includes first compression means, located in said housing between said first sealing means and said second open end of said housing, for exerting an axially directed compression force on said first sealing means, and said second pressure-equalizing means further includes second compression means, located in said housing between said second sealing means and said second open end of said housing, for exerting an axially directed compression force on said second sealing means.

7. An electrical coupling assembly according to claim 5, wherein said first pressure-equalizing means further includes a first substantially incompressible, dielectric flowable material located in said housing between said first movable member and said first sealing means and filling all of the otherwise empty spaces located inside said housing and between said first movable member and said first sealing means, and said second pressure equalizing means further includes a second substantially incompressible, dielectric flowable material located in said housing between said second movable member and said second sealing means and filling all of the otherwise empty spaces located inside said housing and between said second movable member and said second sealing means.

8. An electrical coupling assembly according to claim 7, wherein said first and second movable members are electrical connectors slidably coupled to said first and second ends of said housing.

9. An electrical coupling assembly according to claim 2, wherein said interconnecting means includes a plurality of electrical conductors extending between said first and second connecting ends.

10. An electrical coupling assembly according to claim 9, and further comprising a first electrical connector slidably coupled to said first tubular section and electrically coupled to said plurality of said electrical conductors, and a second electrical connector slidably coupled to said second tubular section and electrically coupled to said plurality of electrical conductors.

11. An electrical coupling assembly for conducting electricity between areas of different pressures, the combination comprising:

a hollow housing having a first and second open ends and an inner tubular surface, said first open end being located in a first area having a first pressure and said second open end being located in a second area having a second higher pressure than the first area;

interconnecting means, located in said housing, for conducting electricity between said first and second open ends of said housing;

first sealing means, located in said housing and engaging said inner surface of said housing, for sealing said housing and said interconnecting means adjacent said first open end of said housing;

first compression means, located in said housing between said first sealing means and said second open end of said housing, for exerting an axially directed compression force on said first sealing means towards said first end;

second sealing means, located in said housing and engaging said inner surface of said housing, for sealing said housing and said interconnecting means adjacent said second open end of said housing; and second compression means, located in said housing between said second sealing means and said second open end of said housing, for exerting an axially directed compression force on said second sealing means towards said first end, said first compression means being located between said first and second sealing means.

12. An electrical coupling assembly according to claim 11, wherein said interconnecting means includes a first connecting end with a first longitudinal axis, and a second connecting end with a longitudinal axis offset from said longitudinal axis of said first connecting end.

13. An electrical coupling assembly according to claim 12, and further comprising first pressure-equalizing means, coupled to said first open end of said housing, for maintaining the pressure inside said housing on said first sealing means at least equal to the pressure acting on said first open end of said housing, and second pressure-equalizing means, coupled to said second open end of said housing, for maintaining the pressure inside said housing on said second sealing means at least equal to the pressure acting on said second open end of said housing.

14. An electrical coupling assembly according to claim 13, wherein said first pressure-equalizing means includes a first longitudinally movable member exposed to the pressure acting on said first open end of said housing, and said second pressure-equalizing means includes a second longitudinally movable member exposed to the pressure acting on said second open end of said housing.

15. An electrical coupling assembly according to claim 14, wherein said inner tubular surface of said housing includes a first tubular section having a longitudinal axis, and a second tubular section having a longitudinal axis offset from said longitudinal axis of said first tubular section.

16. An electrical coupling assembly according to claim 14, wherein said first pressure-equalizing means further includes a first substantially incompressible, dielectric flowable material located in said housing between said first movable member and said first sealing means and filling all of the otherwise empty space located inside said housing and between said first movable member and said first sealing means, and said second pressure equalizing means further includes a second substantially incompressible, dielectric flowable material located in said housing between said second movable member and said second sealing means and filling all of the otherwise empty spaces located inside said housing and between said second movable member and said second sealing means.

17. An electrical coupling assembly according to claim 16, wherein said first and second movable members are electrical connectors slidably coupled to said first and second ends of said housing.

18. An electrical coupling assembly according to claim 14, wherein said first and second tubular sections are connected a central tubular section filled with substantially incompressible, dielectric flowable material.

19. An electrical coupling assembly according to claim 18, wherein said interconnecting means includes a plurality of electrical conductors extending between said first and second connecting ends.

20. An electrical coupling assembly according to claim 19, and further comprising a first electrical connector slidably coupled to said first tubular section and electrically coupled to said plurality of said electrical conductors, and a second electrical connector slidably coupled to said second tubular section and electrically coupled to said plurality of electrical conductors.

* * * * *